US008815021B2

(12) United States Patent
Brouwer et al.

(10) Patent No.: US 8,815,021 B2
(45) Date of Patent: Aug. 26, 2014

(54) OPTIMIZED PASSIVATION ON TI/ZR-BASIS FOR METAL SURFACES

(75) Inventors: Jan-Willem Brouwer, Willich (DE); Jens Kroemer, Duesseldorf (DE); Sophie Cornen, Duesseldorf (DE); Michael Frank, Neuss (DE); Nicole Teubert, Herne (DE); Franz-Adolf Czika, Neuss (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 12/884,359

(22) Filed: Sep. 17, 2010

(65) Prior Publication Data

US 2011/0041957 A1 Feb. 24, 2011

Related U.S. Application Data

(63) Continuation of application No. PCT/EP2009/053109, filed on Mar. 17, 2009.

(30) Foreign Application Priority Data

Mar. 17, 2008 (DE) ..... 10 2008 014 465

(51) Int. Cl.
*C23C 22/34* (2006.01)

(52) U.S. Cl.
USPC ..... 148/247; 148/243; 106/14.05

(58) Field of Classification Search
USPC ..... 148/247, 243; 106/14.05
See application file for complete search history.

(56) References Cited

U.S. PATENT DOCUMENTS

| | | | | |
|---|---|---|---|---|
| 1,710,743 | A | 4/1929 | Pacz | |
| 4,643,778 | A | 2/1987 | Donofrio | |
| 5,342,456 | A | 8/1994 | Dolan | |
| 6,419,731 | B2 * | 7/2002 | Inbe et al. | 106/14.44 |
| 6,764,553 | B2 | 7/2004 | Dolan | |
| 7,063,735 | B2 | 6/2006 | Fristad et al. | |
| 7,819,989 | B2 | 10/2010 | Ishikura et al. | |
| 2003/0150524 | A1 | 8/2003 | Wichelhaus et al. | |
| 2004/0054044 | A1 | 3/2004 | Bittner et al. | |
| 2004/0187967 | A1 | 9/2004 | Matsukawa et al. | |
| 2005/0067057 | A1 * | 3/2005 | Ishikura et al. | 148/273 |
| 2008/0057304 | A1 | 3/2008 | Fristad et al. | |
| 2008/0302448 | A1 | 12/2008 | Frey et al. | |

FOREIGN PATENT DOCUMENTS

| | | | |
|---|---|---|---|
| CN | 101395299 | A | 3/2009 |
| DE | 764929 | C | 4/1954 |
| DE | 1933013 | A1 | 1/1971 |
| EP | 1405933 | A1 | 4/2004 |
| EP | 1571237 | A1 | 9/2005 |
| EP | 1489198 | B1 | 4/2008 |
| JP | 2005264230 | A | 9/2005 |
| KR | 100326612 | B1 | 11/2002 |
| KR | 1020040058039 | A1 | 7/2004 |
| KR | 1020040058040 | A1 | 7/2004 |
| WO | 8505131 | A1 | 11/1985 |
| WO | 9305198 | A1 | 3/1993 |
| WO | 2007065645 | A1 | 6/2007 |
| WO | 2008075739 | A1 | 6/2008 |

OTHER PUBLICATIONS

International Search Report dated Jun. 30, 2009, PCT International Application PCT/EP2009/053109, filed Mar. 17, 2009.
International Search Report dated Sep. 1, 2011 for co-pending, co-owned PCT/US2010/062123, 4 pages.
International Search Report dated May 15, 2009 for co-pending, co-owned PCT/US2009/037372, 1 page.

* cited by examiner

*Primary Examiner* — Lois Zheng
(74) *Attorney, Agent, or Firm* — Mary K. Cameron

(57) ABSTRACT

The present invention relates to a chromium-free aqueous agent based on water-soluble compounds of titanium and/or zirconium and a source of fluoride ions, copper ions and metal ions selected from the group consisting of calcium, magnesium, aluminum, boron, zinc, iron, manganese and/or tungstene and to a method for the anti-corrosive conversion treatment of metal surfaces. The chromium-free aqueous agent is suitable for the treatment of various metal materials, joined in composite structures, amongst others of steel or galvanized steel or the alloys thereof or any combinations of said materials. Furthermore, surfaces of aluminum and alloys thereof can be treated in an anti-corrosive manner using the agent according to the invention. The anti-corrosive treatment is intended in particular as a pretreatment for a subsequent dip-coating. The invention further relates to a metallic substrate that was treated according to a predefined method sequence with the chromium-free agent according to the invention and to the use thereof, particularly in the automotive production of vehicle bodies.

12 Claims, No Drawings

OPTIMIZED PASSIVATION ON TI/ZR-BASIS FOR METAL SURFACES

CROSS-REFERENCE TO RELATED APPLICATIONS

This application is a continuation under 35 U.S.C. Sections 365(c) and 120 of International Application No. PCT/EP2009/053109, filed Mar. 17, 2009 and published on Sep. 24, 2009 as WO 2009/115504, which claims priority from German Patent Application Serial No. 10 2008 014 465.7 filed Mar. 17, 2008, which are incorporated herein by reference in their entirety.

The present invention relates to a chromium-free aqueous agent based on water-soluble compounds of titanium and/or zirconium and to a method for the anticorrosion conversion treatment of metallic surfaces. The chromium-free aqueous agent is suitable for treating various metallic materials which are joined together to form composite structures, inter alia steel or galvanized or alloy-galvanized steel and any combinations of these materials. Surfaces of aluminum and the alloys thereof may moreover be subjected to an anticorrosion treatment using the agents according to the invention. The anticorrosion treatment is primarily intended as a pretreatment for subsequent dipcoating. The invention furthermore comprises a metallic substrate which has been treated in accordance with a predetermined processing sequence using the chromium-free agent according to the invention, and the use thereof, in particular in automotive body production.

Anticorrosion agents which are an acidic aqueous solution of fluoro complexes have long been known. They are increasingly being used instead of chromating methods, which are being ever less frequently used due to the toxicological characteristics of chromium compounds. In general, such solutions of fluoro complexes contain further anticorrosion active ingredients which further enhance the anticorrosion action and coating adhesion.

DE-A-19 33 013, for example, describes a treatment solution in one exemplary embodiment which is an aqueous solution of ammonium hexafluorozirconate, sodium nitrate, cobalt nitrate and sodium m-nitrobenzenesulfonate and has a pH value of 5.2. The solution may be used for treating zinc, steel or aluminum surfaces. EP-A-1 571 237 describes a treatment solution and treatment method for surfaces containing iron, zinc, aluminum and magnesium. This solution has a pH value in the range from 2 to 6 and contains 5 to 5000 ppm of zirconium and/or titanium and 0.1 to 100 ppm of free fluoride. The solution may additionally contain further components selected from chlorate, bromate, nitrite, nitrate, permanganate, vanadate, hydrogen peroxide, tungstate, molybdate or in each case the associated acids. Organic polymers may likewise be present. After treatment with such a solution, the metal surfaces may be rinsed with a further passivating solution.

WO 93/05198 describes a "dry-in-place" method, in which chromium-free agents containing fluoro complexes of titanium, zirconium, hafnium, silicon and boron as one component and cations of elements selected from cobalt, magnesium, titanium, zinc, nickel, tin, zirconium, iron, aluminum and copper as a second component, it being necessary for the two components to be present in a specific minimum ratio relative to one another, are applied in particular onto galvanized steel surfaces. The exemplary embodiments document the advantageous effect of compositions which contain compounds of cobalt or magnesium as the second component.

WO 07/065,645 likewise discloses aqueous compositions which contain fluoro complexes of inter alia titanium and/or zirconium, a further component additionally being present which is selected from: nitrate ions, copper ions, silver ions, vanadium or vanadate ions, bismuth ions, magnesium ions, zinc ions, manganese ions, cobalt ions, nickel ions, tin ions, buffer systems for the pH range from 2.5 to 5.5, aromatic carboxylic acids with at least two groups which contain donor atoms, or derivatives of such carboxylic acids, silica particles with an average particle size of below 1 μm. WO 07/065,645 furthermore teaches that, in order to scavenge excess free fluoride, aluminum ions may additionally be added as a "fluoride scavenger", but without indicating what constitutes an excess of free fluoride or the conditions under which aluminum ions may be used as "fluoride scavengers".

EP 1405933 discloses a composition for treating iron and/or zinc surfaces which contains at least one metal from the group Ti, Zr, Hf and Si and a source of fluorine ions, the condition being set for the concentration ratios of these two components that the quantity of free fluorine ions does not exceed 500 ppm. Compounds containing the elements silver, aluminum, copper, iron, manganese, magnesium, nickel, cobalt and zinc are mentioned as "fluoride scavengers".

The object of the present invention is accordingly to provide an aqueous chromium-free, titanium and/or zirconium-based agent for the conversion treatment of metallic surfaces, which at elevated fluoride contents of the agent still effect optimum passivating conversion of the treated metal surface, such that, on the one hand, adequate anticorrosion protection is imparted to the directly treated metallic component and, on the other hand, in conjunction with an organic primer coat or an organic dipcoat, the elevated requirements for permanent anticorrosion protection are satisfied, it being necessary to ensure extraordinarily good coating adhesion.

Elevated fluoride contents as mentioned in the statement of the object occur in the aqueous agent when the total number of fluorine atoms is greater than the maximum number of fluorine atoms complexable by the elements titanium and/or zirconium, i.e. when the molar ratio of the total number of fluorine atoms to the total number of titanium and/or zirconium atoms exceeds a value of 6.

The stated object is achieved by an aqueous chromium-free agent suitable for the conversion treatment of metallic surfaces containing (A) one or more water-soluble compounds containing at least one atom selected from the elements titanium and/or zirconium, the total concentration of these elements being no less than $2.5\text{-}10^4$ mol/l, but no greater than $2.0\cdot10^{-2}$ mol/l.

(B) one or more water-soluble compounds, as a source of fluoride ions, containing at least one fluorine atom, the agent containing the stated elements of the particular components (A) and (B) in a molar ratio A:B of 1:z, z being a real number R and greater than 6 $\{z\epsilon R|z>6\}$, wherein the agent additionally contains (C) one or more water-soluble compounds, which release copper ions, containing at least one copper atom, and (D) one or more water-soluble and/or water-dispersible compounds, which release metal ions, but are not a source of fluoride ions, containing at least one metal atom selected from the group consisting of calcium, magnesium, aluminum, boron, iron, manganese and/or tungsten, the molar ratio D:B of the total number of component (D) metal atoms to the total number of component (B) fluorine atoms not falling below a value which, once the agent has been brought into contact with a ferrous surface, preferably with an unalloyed steel surface, for a treatment time of 90 s and at a treatment temperature of 30° C., results in an elemental loading on said surface of less than 20 mg/m$^2$ relative to the component (A) elements selected from titanium and/or zirconium.

The minimum concentration according to the invention of the component (A) elements titanium and/or zirconium is a threshold value with regard to formation of the conversion layer and must therefore be present in the aqueous agent. If the concentration is below this value, the metallic surface is not homogeneously converted to form a mixed oxide/hydroxide zirconium-containing passivation layer and the elemental loadings relative to the elements titanium and/or zirconium are distinctly below 20 mg/m$^2$. In such a case, copper deposition dominates, while virtually none of the passivating outer layer is formed.

On the other hand, concentrations of the elements titanium and/or zirconium according to components (A) of more than $2.0 \cdot 10^{-2}$ mol/l in the aqueous agent are not economically viable and moreover provide no additional advantages in terms of anticorrosion protection in the treatment of metallic components. Instead, such high concentrations complicate processability and increase the operating costs of the conversion baths as a consequence of the resultant inevitable additional regeneration and reprocessing operations.

Such aqueous chromium-free agents which are in particular preferred are those whose component (A) consists solely of water-soluble compounds of zirconium.

Alternatively, the object underlying the invention is achieved by an aqueous chromium-free agent suitable for the conversion treatment of metallic surfaces containing (A) one or more water-soluble compounds containing at least one atom selected from the elements titanium and/or zirconium, the total concentration of these elements being no less than $2.5 \cdot 10^{-4}$ mol/l, but no greater than $2.0 \cdot 10^{-2}$ mol/l.

(B) one or more water-soluble compounds, as a source of fluoride ions, containing at least one fluorine atom, the agent containing the stated elements of the particular components (A) and (B) in a molar ratio A:B of 1:z, z being a real number R and greater than 6 $\{z \in R | z > 6\}$, wherein the agent additionally contains (C) one or more water-soluble compounds, which release copper ions, containing at least one copper atom, and (D) one or more water-soluble and/or water-dispersible compounds, which release metal ions, but are not a source of fluoride ions, containing at least one metal atom selected from the group consisting of calcium, magnesium, aluminum, boron, iron, manganese and/or tungsten, the molar ratio D:B of the total number of component (D) metal atoms to the total number of component (B) fluorine atoms being no less than $$\frac{z-6}{4z}.$$

Complying with this specific molar ratio D:B of the total number of component (D) metal atoms to the total number of component (B) fluorine atoms of at least $$\frac{z-6}{4z}$$

ensures that a sufficient quantity of "fluoride scavengers" is present in the agent according to the invention in order, once the agent has been brought into contact with a ferrous surface, preferably with an unalloyed steel surface, for a treatment time of 90 s and at a treatment temperature of 30° C., to result in an elemental loading on said surface of at least 20 mg/m$^2$ relative to the component (A) elements selected from titanium and/or zirconium.

Agents according to the invention which do not fall below this specific molar ratio D:B of $$\frac{z-6}{4z}$$

produce, in particular when they are applied by a dipping method, a sufficiently passivating conversion of the metal surfaces.

Especially when the agent according to the invention is applied by spraying, it has however been found that, even at lower molar ratios D:B than those specified by the quotient $$\frac{z-6}{4z},$$

an anticorrosion pretreatment according to the invention may proceed on metallic surfaces, such that the primary condition which must be met is just that the molar ratio D:B does not fall below a value which, once the agent has been brought into contact with a ferrous surface, preferably with an unalloyed steel surface, for a treatment time of 90 s and at a treatment temperature of 30° C., results in an elemental loading on said surface of less than 20 mg/m$^2$ relative to the component (A) elements selected from titanium and/or zirconium.

The quotient D:B of at least $$\frac{z-6}{4z}$$

may accordingly also be considered to be a guide value for a composition according to the invention which, irrespective of the specific method used during contacting of the composition, effects a sufficient passivating conversion of the metal surface, such sufficient conversion additionally being subject to the condition that the quotient D:B does not fall below any values which, once the agent has been brought into contact with a ferrous surface, preferably with an unalloyed steel surface, for a treatment time of 90 s and at a treatment temperature of 30° C., achieve an elemental loading on said surface of less than 20 Mg/m$^2$ relative to the component (A) elements selected from titanium and/or zirconium.

In particular, it has been found that such aqueous agents which are advantageous for formation of the conversion layer are those in which the molar ratio D:B of the total number of component (D) metal atoms to the total number of component (B) fluorine atoms is no less than $$\frac{z-6}{3z},$$

preferably no less than $$\frac{z-6}{2z}.$$

The advantageous effect relates to shifting the composition of the formation of the conversion layer after treatment of a metallic surface with the agents according to the invention in favor of higher elemental loadings with regard to the elements titanium and/or zirconium, in particular relative to the elemental loading for copper, so resulting in greater anticorrosion protection and improved adhesion characteristics towards subsequently applied organic topcoat layers. The chromium-free agent based on compounds of titanium and/or zirconium is preferably according to the invention when the molar ratio D:B does not exceed any values which, once the agent has been brought into contact with a ferrous surface, preferably with an unalloyed steel surface, for a treatment time of 90 s and at a treatment temperature of 30° C., result in an elemental loading on said surface of less than 20 $mg/m^2$ relative to the component (A) elements selected from titanium and/or zirconium. It has proved possible to demonstrate in this connection that continuous, homogeneous conversion layers are not formed until elemental loadings of the elements titanium and/or zirconium of roughly 20 $mg/m^2$ are achieved. If conversion of the metal surface is inadequate, electroless deposition of metallic copper predominates in the aqueous chromium-free agent when copper ions are present. Application of a predominantly metallic protective coating is, however, not suitable for developing satisfactory anticorrosion protection and in particular for imparting satisfactory adhesion towards organic topcoats. Optimum results in terms of anticorrosion protection are achieved by agents according to the invention when such agents bring about, on the one hand, complete and homogeneous formation of the inorganic conversion layer and, on the other hand, local deposition of copper at defects in the conversion layer. It has proved possible to demonstrate empirically in this connection that such passivation layers preferably exhibit an elemental loading relative to the component (A) elements titanium and/or zirconium of at least 20 $mg/m^2$, particularly preferably of at least 40 $mg/m^2$, with the elemental loading relative to copper according to component (C) simultaneously preferably not exceeding 100 $mg/m^2$, particularly preferably 80 $mg/m^2$, but copper deposition of at least 10 $mg/m^2$ preferably being obtained. Preferred agents according to the invention are those for which the molar ratio A:C of the total number of atoms of the component (A) elements titanium and/or zirconium to the total number of component (C) copper atoms is no less than 1:3, preferably no less than 2:3. While adequate inorganic conversion of the metallic surface may indeed take place if the A:C ratio falls below the preferred range in the agents according to the invention, the elemental loadings with regard to copper are usually greater than 100 $mg/m^2$. In an extreme case, i.e. if the ratio is distinctly below the preferred level, titanium and/or zirconium-based conversion is largely suppressed and coatings of amorphous metallic copper which can be wiped off are the result. Conversely, preferred agents according to the invention are those in which the ratio A:C of the total number of atoms of the component (A) elements titanium and/or zirconium to the total number of component (C) copper atoms does not exceed any values which, once the agent has been brought into contact with a ferrous surface, preferably with an unalloyed steel surface for a treatment time of 90 s and at a treatment temperature of 30° C., result in an elemental loading on said surface of less than 20 $mg/m^2$ relative to the component (A) elements selected from titanium and/or zirconium or of more than 100 $mg/m^2$ relative to the component (C) element copper.

Water-soluble compounds according to the invention corresponding to components (A)-(D) are those which, when in aqueous solution, are in chemical equilibrium with ionic species containing the particular stated elements or with ionic species of the stated elements themselves. The chemical equilibrium which is established in the aqueous solution between the ionic species and undissociated water-soluble compound corresponding to components (A)-(D) must here be qualitatively detectable using conventional methods, i.e. the ionic species must be present per se in the aqueous phase at least in an analytically determinable quantity. Water-dispersible compounds according to the invention corresponding to component (D), in contrast, are solely characterized by their ionogenic structure and contain at least one of the particular stated elements according to component (D) as an ionic constituent in an inorganic matrix. The proportion of the ionic species in the aqueous phase is here predetermined by the solubility product of the water-dispersible compound.

Preferred component (A) water-soluble compounds are compounds which, in aqueous solution, dissociate into anions of fluoro complexes of the elements titanium and/or zirconium. Such preferred compounds are for example $H_2ZrF_6$, $K_2ZrF_6$, $Na_2ZrF_6$ and $(NH_4)_2ZrF_6$ and the analogous titanium compounds. Such fluorine-containing compounds according to component (A) are simultaneously water-soluble compounds according to component (B) according to the invention and vice versa. Fluorine-free compounds of the elements titanium and/or zirconium may also be used as component (A) water-soluble compounds according to the invention, for example $(NH_4)_2Zr(OH)_2(CO_3)_2$ or $TiO(SO_4)$.

Preferred component (B) water-soluble compounds, which serve as a source of fluoride ions, are, in addition to the fluorometallates already mentioned, hydrogen fluoride, alkali metal fluorides, ammonium fluoride and/or ammonium bifluoride.

Preferred component (C) water-soluble compounds, which release copper ions, are any water-soluble copper salts which contain no chloride ions. In particular, copper sulfate, copper nitrate and copper acetate are preferred.

Component (D) water-soluble compounds which release metal ions, but are not a source of fluoride ions, and contain at least one metal atom selected from the group consisting of calcium, magnesium, aluminum, boron, iron, manganese and/or tungsten are preferably those which release only calcium, aluminum, and/or iron ions, particularly preferably only those which release aluminum and/or iron ions and in particular those which solely release aluminum ions.

These include all water-soluble salts of the above-stated metals according to component (D) which contain neither fluoride nor chloride ions.

Typical compounds according to component (D) which may be mentioned by way of example are calcium citrate, magnesium sulfate, aluminum nitrate, alkali metal borates, boric acid, iron(III) nitrate, iron(II) sulfate, manganese(II) sulfate, ammonium tungstate(VI).

Preferred component (D) water-dispersible compounds are compounds based on silicates containing aluminum, particularly preferably compounds of aluminum silicate with a ratio of aluminum to silicon atoms of at least 1:3. Preferred compounds are in particular aluminum silicates of the empirical formula $(Na, K)_x(Ca, Mg)_{1-x}Al_{2-x}Si_{2+x}O_8$ (with $0 \leq x \leq 1$), the compound preferably being a zeolite with regard to its crystal morphology.

In principle, such component (D) water-dispersible compounds which are preferred are those whose average particle diameter does not exceed 100 nm, particularly preferably 20 nm.

If component (D) in a preferred embodiment of the agent according to the invention is at least partially composed of water-soluble and/or water-dispersible compounds which contain aluminum ions, the molar ratio D:B of the total number of component (D) aluminum atoms to the total number of component (B) fluorine atoms is preferably no greater than $$\frac{z-6}{z}.$$

It has been found that a higher relative proportion of aluminum, in particular the relative proportion of cations of aluminum, in the agents according to the invention increasingly inhibits formation of the titanium and/or zirconium-based conversion layer, such that treatment of ferrous surfaces, preferably of unalloyed steel surfaces, with such a chromium-free agent tends to result in lower elemental loadings relative to the elements titanium and/or zirconium which may be insufficient for adequate anticorrosion protection.

Such chromium-free agents according to the invention which are furthermore preferred are those in which the total content of fluorine atoms corresponding to component (B) is limited to 2 g/l, preferably to 1 g/l. Higher fluorine contents are uneconomic, due to the considerable contents of compounds according to component (D) which are then likewise present, and so increase the operating costs of the conversion baths as a consequence of the resultant inevitable additional regeneration and reprocessing operations.

The present invention is furthermore distinguished in that the chromium-free agent need not contain any additional polymeric compounds for an effective passivating treatment. Small quantities of organic polymers such as derivatives of polyacrylates, polyvinyl alcohols, polyvinyl phenols, polyvinylpyrrolidones or block copolymers consisting of structural units of the above-stated polymers may, however, be beneficial for the stability of agents according to the invention which contain water-dispersible compounds according to component (D). It is therefore preferred for the total content of organic polymers in the agents according to the invention to amount to less than 50 ppm, preferably less than 10 ppm and particularly preferably less than 1 ppm. In one specific embodiment, the agent according to the invention contains no organic polymer.

On treatment of metallic surfaces, a proportion of phosphate anions in the agents according to the invention generally results in phosphate-containing conversion layers which contain an elevated proportion of bound metal cations of the particular pickled substrate, specifically zinc and iron cations. Such passivation layers likewise have anticorrosion characteristics, but these differ significantly from titanium and/or zirconium-based conversion layers derived from phosphate-free agents according to the invention. In addition, the synergistic effect during development of the conversion layer in the presence of copper ions according to component (B), which is primarily observed in phosphate-free agents according to the invention where it brings about elevated anticorrosion protection and improved adhesion characteristics to organic topcoats, is less strongly pronounced in phosphate-containing agents according to the invention. An additional disadvantage of phosphate-containing agents according to the invention is elevated sludge formation due to local precipitation of sparingly soluble phosphates. In a further preferred embodiment, the agent according to the invention therefore contains less than 5 ppm and particularly preferably no oxo anions of phosphorus.

The pH value of the agent according to the invention is preferably no less than 2.5, particularly preferably no less than 3.5, wherein however a pH value of preferably 5, particularly preferably of 4.5 is not exceeded. The pH value is preferably adjusted to the stated acidic range by using the fluoro complexes of the elements titanium and/or zirconium as component (A) or component (B) at least partially in the form of an acid. The value may, however, also be adjusted by another acid, for example nitric acid and sulfuric acid. Additionally, if it is desired to use the agent according to the invention at higher pH values, the pH value may be adjusted accordingly by addition of alkali metal hydroxides or carbonates, ammonia or organic amines.

In a further preferred embodiment of the agent according to the invention, a buffer system is additionally present to adjust the total acid content, said buffer system exhibiting a proteolysis equilibrium with a pK value in the range from 2.5 to 5. An acetic acid/acetate buffer is in particular suitable as a buffer system for the stated pH range. Another suitable buffer system is based on potassium hydrogenphthalate. Raising the total acid content by addition of a buffer system increases the stability of the agent according to the invention and facilitates establishing the pH of the agent. Adjusting the agent according to the invention to a defined pH value is necessary in order to achieve consistent quality of the conversion layer when the agent is used, for example, as a dip bath in a continuous method for the anticorrosion treatment of metallic components.

It has been found that such an adequate buffer capacity is one at which the pH value of the agent according to the invention in the preferred pH range of 2.5 to 5.5 changes by preferably no more than 0.2 units on introduction of one gram equivalent of acid or alkali per liter of solution. Such a buffer capacity of the agent according to the invention also prevails when the total acid content relative to the total content of fluorine preferably amounts to no less than 5 points, particularly preferably no less than 6 points, but preferably no more than 10 points per 100 ppm of fluorine.

In addition to the components of the agent according to the invention which have already been mentioned, the aqueous treatment solution may contain compounds which are used as "accelerators" in layer-forming phosphating. These accelerators have the characteristic of scavenging hydrogen atoms which arise from the pickling attack of the acid on the metal surface. This reaction, which is also known as "depolarization", facilitates the attack of the acidic treatment solution on the metal surface and so accelerates formation of the anticorrosion protection layer. The following is a non-exhaustive list of preferred accelerators in the particular preferred concentration ranges:

0.05 to 2 g/l m-nitrobenzenesulfonate ions,
0.1 to 10 g/l hydroxylamine in free, ionic or bound form,
0.05 to 2 g/l m-nitrobenzoate ions,
0.05 to 2 g/l p-nitrophenol,
1 to 70 mg/l hydrogen peroxide in free or bound form,
0.05 to 10 g/l organic N-oxides
0.1 to 3 g/l nitroguanidine
1 to 500 mg/l nitrite ions
1 to 1000 mg/l nitrate ions
0.5 to 5 g/l chlorate ions.

The agent of the present invention may be produced at the place of use by dissolving the stated components (A)-(D) in water and adjusting of the pH value. This procedure is, however, not usual practice. Instead, in practice aqueous concentrates are conventionally provided from which the ready-to-use chromium-free agent is produced at the place of use by dilution with water and, if necessary, adjustment of the pH value. The present invention accordingly likewise provides an aqueous concentrate which, on dilution with water by a factor of approx. 10 to approx. 100, in particular by a factor in the range from approx. 20 to approx. 50 and, if necessary, after adjustment of the pH value gives rise to an acidic, chromium-free, aqueous solution according to the above description of the invention. For stability reasons, such concentrates are often adjusted such that, on dilution with water, the pH value is not immediately in the necessary range. In this case, after dilution with water, the pH value must be corrected either downwards or upwards. The pH value is adjusted as has already been described by the addition of suitable acids or bases. According to another aspect, the present invention relates to a method for the anticorrosion conversion treatment of metallic surfaces, wherein the cleaned metallic surface is brought into contact with the aqueous chromium-free agent according to the invention. This may proceed, for example, by immersion in the treatment solution ("dipping method") or by spraying ("spraying method") with the chromium-free agent. The temperature of the agent according to the invention is here preferably in the range from 15 to 60° C., in particular in the range from 25 to 50° C. The necessary treatment time is here a time interval adapted to the convection in the bath installation and typical of the composition of the metallic component to be treated. The contact time with the chromium-free agent preferably amounts, however, to at least 30 sec, particularly preferably at least 1 minute, but should however preferably not exceed 10 minutes, particularly preferably 5 minutes. After this contact, rinsing is performed, preferably with water, in particular with deionized water.

Residues of oil and grease are previously removed from the metal surfaces to be treated in a cleaning step. At the same time, a reproducible metal surface is consequently produced which ensures a consistent layer quality after conversion treatment with the agent according to the invention. This preferably comprises alkaline cleaning with conventional commercial products known to a person skilled in the art.

Metallic surfaces for the purposes of the present invention are surfaces of iron, steel, galvanized and alloy-galvanized iron and steel, which may be obtained, for example, under the conventional commercial names Galfan®, Galvalume®, Galvannealed®. Metallic surfaces which may be provided with an anticorrosion pretreatment with the agent according to the invention also include aluminum and zinc and the alloys thereof with an alloy content of aluminum or zinc of at least 50 atom %. The metallic surface treated in the method according to the invention is preferably a "bright" metal surface. "Bright" metal surfaces are taken to mean metal surfaces which do not yet have an anticorrosion coating. The method according to the invention thus comprises the first or only treatment step which produces an anticorrosion protection layer which may in turn serve as the base for a subsequent coating. It thus does not comprise a post-treatment of a previously produced anticorrosion protection layer, such as for example a phosphate layer.

According to the invention, no further measures are necessary, and should even preferably be avoided, according to this further aspect of the invention by which the metal surface is dried after contact with the chromium-free agent and before coating with a dipcoat, for example a cathodic electrodipcoat. Unintentional drying may, however, occur in the case of plant stoppage if the treated metal surface, for example an automotive body or a part thereof, is exposed to air between the bath comprising the agent according to the invention and the dipcoat bath. Such unintentional drying does, however, not cause any harm. According to the invention, a dipcoat comprises not only those aqueous dispersions of organic polymers which are applied by dipping without an external electrical current, i.e. by self-deposition, onto the metal surface but also those in which coating with the coating material proceeds from the aqueous phase by application of an external voltage source.

The present invention furthermore provides a metallic substrate which has been treated by the above-described method with the agents according to the invention, the surface of the metallic substrate exhibiting a titanium and/or zirconium elemental loading of preferably no less than 20 mg/m$^2$ and preferably of no more than 150 mg/m$^2$. Metallic substrates which are here preferred are those in which the elemental loading relative to copper does not exceed 100 mg/m$^2$, preferably 80 mg/m$^2$, but at least 10 mg/m$^2$ of copper is deposited.

The use according to the invention of such metallic substrates in industrial surface finishing processes by subsequent application of a multilayer system is provided by the present invention.

Moreover, the metallic materials, components and composite structures conversion treated in accordance with the present invention are used in the production of semifinished products, in automotive body construction, in shipbuilding, in construction and the architectural sector and for the production of white goods and electronic housings.

The following exemplary embodiments demonstrate the technical advantages of the method according to the invention and of the new chromium-free agent according to the invention.

The aqueous chromium-free agent according to the invention and the corresponding processing sequence for the conversion treatment of metallic surfaces was tested on test sheets made from cold-rolled steel (CRS ST1405, from Sidca or MBS 25, from Chemetall).

The processing sequence for the treatment according to the invention of the metal test sheets, as is in principle also conventional in automotive body production, is shown below. The metal sheets were first of all subjected to alkaline cleaning and degreasing at 60° C. for 5 minutes. Surfactant-containing mixtures of conventional commercial products of the present applicant were used for this purpose: mixture containing 3% Ridoline® 1574A and 0.3% Ridosol® 1270. There then followed a rinsing operation with process water followed by a further rinse cycle with deionized water ($\kappa<1$ $\mu Scm^{-1}$), before the cold-rolled steel sheets were treated with a chromium-free agent at 30° C. for 90 sec. The quality of the conversion treatment was assessed by subjecting the freshly treated steel sheets to a "process water test". The "process water test" involves verifying and evaluating the homogeneity of the conversion coating after treatment with the agents according to the invention. To this end, the freshly treated steel sheets were first of all blown dry, then immediately dipped into process water at 20° C. for 30 sec and then air dried. According to the present invention, "process water" is water which exhibits a predetermined range of values for specific characteristic values selected from conductivity, pH value, chloride and nitrate ion content and copper content. In general, the process water for use according to the invention in the "process water test" must meet the requirements according to EU Council Directive 98/83/EC, the characteristic values for the chemical parameters for process water listed in the following table being binding for carrying out the "process water test".

| Parameter | Characteristic values |
|---|---|
| Conductivity | 500-900 $\mu Scm^{-1}$ at 20° C. |
| pH value | 6.5-7.5 |
| Chloride | <250 ppm |
| Nitrate | <50 ppm |
| Copper | <0.1 ppm |
| Residual heavy metals | <500 ppb |

Once the steel sheets have been treated according to the "process water test" as described above, red rust formation is assessed according to the following scale:

0: no visible formation of red rust
1: scarcely any/very little red rust (<10%)
2: little red rust (<20%)
3: distinct formation of red rust (<30%)
4: predominant red rust (>50%)

Red rust here describes the red colored corrosion products of iron, typically iron oxide. Red rust is formed virtually instantaneously on exposure of iron in a moist atmosphere. A thin film of process water on a ferrous surface is thus sufficient to initiate formation of red rust. However, formation of red rust comes to a standstill in a dry atmosphere, such that a good assessment of the homogeneity of an anticorrosion conversion layer formed on ferrous surfaces can be made on the basis of the induced formation of red rust. If the steel surface treated with the chromium-free agent yields a homogeneous, continuous conversion layer, formation of red rust is minimal or not visible to the human eye. Conversely, clearly recognizable red rust is formed in the "process water test" on macroscopic defects due to inadequate formation of the layer or to passivation layers which are too thin overall.

Table 1 shows chromium-free zirconium-based agents for the anticorrosion pretreatment of metal surfaces which were used on cold-rolled steel in accordance with the above-described method.

The particular components (A)-(D) according to the terminology of the present invention are:

(A) $H_2ZrF_6$ (B) $H_2ZrF_6$, $(NH_4)HF_2$ (C) $CU(NO_3)_2.3H_2O$ (D) $Fe(NO_3)_3.9H_2O$ [Tables 1, 3] or $Al(NO_3)_3.9H_2O$ [Table 2]

It is first of all clear from Table 1 that while chromium-free agents containing no copper ions (VB1) do indeed bring about an adequate elemental loading of >20 mg/m$^2$ on the steel surface, such a conversion layer cannot completely suppress the occurrence of red rust. In contrast, in the presence of copper ions in the agent according to the invention (B1), both zirconium and copper are incorporated into the passivation layer, elemental loadings of zirconium being achieved which distinctly exceed the elemental loadings achieved by copper-free compositions (VB1). This synergistic effect and the simultaneous deposition of copper results in red rust formation scarcely occurring or being completely suppressed in the "process water test". At a constant molar ratio of the proportion of zirconium to copper (A:C), the synergistic effect, which amounts to acceleration of conversion layer formation, is independent of the total quantity of zirconium (B2). At least with regard to the formation of red rust after the "process water test", higher proportions of copper deposited in the conversion layer have little impact, as is apparent from a comparison of the Examples B1 and B2 according to the invention. A further aspect of the present invention is that the total fluoride content relative to the proportion of "fluoride scavenger" (component D) must not fall below a specific value according to the invention. It is clear in this connection from a comparison of Examples VB2 and B1 that doubling the fluoride content (component B) at a constant proportion of iron ions (VB2) results in complete inhibition of conversion layer formation (elemental loading Zr: <1.5 mg/m$^2$) and only metallic copper is deposited on the steel surface (elemental loading Cu: 67 mg/m$^2$). The actual ratio of the "fluoride scavenger" iron to the total content of fluorine of 1:22 is distinctly below the minimum molar ratio D:B according to the invention of 1:7.6. In particular for chromium-free agents according to the invention solely containing aluminum as "fluoride scavenger" (component D), the content of aluminum relative to the proportion of fluorine determines the quality of conversion layer formation. Table 2 lists for this purpose chromium-free agents with a rising proportion of zirconium (component A) and a simultaneously falling proportion of copper ions (component C), the example according to the invention in each case exhibiting a molar ratio D:B of aluminum to fluorine of 1:4. Satisfactory results with regard to the "process water test", are here only achieved for the treatment of steel sheets when agents B3-B5 according to the invention are used. If the molar ratio of D:B in the chromium-free agent is below the nominal value, as has already been shown by VB2 in Table 1, formation of the conversion layer is inhibited, such that significant formation of red rust is observed after the "process water test" (VB1-VB3). It should at the same time be noted that the synergistic effect of copper ions declines distinctly as soon as the molar ratio of zirconium to copper in the agents according to the invention is greatly increased (B6). In this case, the achieved elemental loading relative both to zirconium and to copper is reduced in such a manner that appreciable red rust is formed in the "process water test" (B6). The results from Table 3 for conversion treated steel surfaces in corrosive coating adhesion and in the stone impact test confirm that there is a positive effect on coating adhesion both at very high (B7) and very low (B11) relative copper contents in the chromium-free agent. All the agents according to the invention, in which the molar ratio A:C varies between 1:14 and 37:1, are superior to copper-free agents (VB7) for conversion treatment, provided that the total content of zirconium (component A) in the agent is sufficient to bring about conversion of the surface at an optimally adjusted molar ratio D:B of "fluoride scavenger" to fluorine content (VB6).

TABLE 1

Influence of fluorine content in the chromium-free agent containing iron(III) ions (D) on formation of the conversion layer on steel (MBS 25, from Chemetall) and on formation of red rust in the "process water test"

| | Components | | | | | | | *Elemental loading | |
|---|---|---|---|---|---|---|---|---|---|
| | A | B | C | D | Molar ratios | | | in mg/m$^2$ | "Process water test" |
| Test | Zr/mM | F/mM | Cu/mM | Fe/mM | z | A:C | D:B | Zr/Cu | (0-4) |
| VB1 | 10.6 | 65.8 | — | 3.0 | 6.21 | — | 1:22 | 26.6/— | 1-2 |
| VB2 | 5.2 | 65.8 | 0.8 | 3.0 | 12.65 | 6.5:1 | 1:22 | <1.5/67 | 3 |
| B1 | 5.2 | 32.9 | 0.8 | 3.0 | 6.37 | 6.5:1 | 1:11 | 65/74 | 0-1 |
| B2 | 10.6 | 65.8 | 1.6 | 3.0 | 6.21 | 6.5:1 | 1:22 | 61/121 | 0-1 |

*Elemental loading was determined by means of X-ray fluorescence analysis (XFA)

TABLE 2

Influence of fluorine content in the chromium-free agent containing aluminum ions (D) on formation of the conversion layer on steel (MBS 25, from Chemetall) and on formation of red rust in the "process water test"

| | Components | | | | Molar ratios | | | | #"Process water test" |
|---|---|---|---|---|---|---|---|---|---|
| | A | B | C | D | | | D:B | D:B | |
| Test | Zr/mM | F/mM | Cu/mM | Al/mM | z | A:C | Actual | Nominal | Red rust yes/no |
| VB3 | 2.6 | 25.3 | 0.47 | 1.6 | 9.7 | 5.5:1 | 1:16 | >1:10 | yes |
| B3 | 2.6 | 25.3 | 0.47 | 6.3 | 9.7 | 5.5:1 | 1:4 | >1:10 | no |

TABLE 2-continued

Influence of fluorine content in the chromium-free agent containing aluminum ions (D) on formation of the conversion layer on steel (MBS 25, from Chemetall) and on formation of red rust in the "process water test"

| | Components | | | | Molar ratios | | | | #"Process water test" |
|---|---|---|---|---|---|---|---|---|---|
| Test | A Zr/mM | B F/mM | C Cu/mM | D Al/mM | z | A:C | D:B Actual | D:B Nominal | Red rust yes/no |
| VB4 | 7.7 | 73.7 | 0.31 | 4.7 | 9.6 | 25:1 | 1:16 | >1:11 | yes |
| B4 | 7.7 | 73.7 | 0.31 | 18.5 | 9.6 | 25:1 | 1:4 | >1:11 | no |
| VB5 | 8.2 | 79.0 | 0.12 | 5.0 | 9.6 | 68:1 | 1:16 | >1:11 | yes |
| B5 | 8.2 | 79.0 | 0.12 | 19.8 | 9.6 | 68:1 | 1:4 | >1:11 | no |
| B6 | 11.0 | 105.3 | $1.6 \cdot 10^{-2}$ | 26.4 | 9.6 | 687:1 | 1:4 | >1:11 | yes |

#Modified "process water test" limited to formation of red rust >10% = "yes"

TABLE 3

Influence of the molar ratio of zirconium to copper (A:C) in the chromium-free agent on corrosive creepage and stone impact test on steel (CRS ST1405, from Sidca) electrodipcoated[1] and treated with the chromium-free agent

| | Components | | | | | | | *VDA Alternating Test | |
|---|---|---|---|---|---|---|---|---|---|
| | A | B | C | D | Molar ratios | | | U/2 | #K value |
| Test | Zr/mM | F/mM | Cu/mM | Fe/mM | z | A:C | D:B | mm | (0.5-5) |
| VB6 | 0.22 | 3.3 | 0.79 | 3 | 15 | 1:3.5 | 1:1.1 | 5.0 | 4.5 |
| VB7 | 1.1 | 8.6 | — | 3 | 7.82 | ∞ | 1:2.9 | 4.2 | 4.5 |
| B7 | 0.55 | 5.3 | 7.7 | 3 | 9.64 | 1:14 | 1:1.8 | 3.0 | 4.0 |
| B8 | 1.1 | 8.6 | 0.79 | 3 | 7.82 | 1.4:1 | 1:2.9 | 1.0 | 2.5 |
| B9 | 1.1 | 8.6 | 0.31 | 3 | 7.82 | 3.5:1 | 1:2.9 | 1.6 | 3 |
| B10 | 5.5 | 35.0 | 0.79 | 3 | 6.36 | 7:1 | 1:11.7 | 1.9 | 3 |
| B11 | 1.1 | 8.6 | 0.03 | 3 | 6.21 | 37:1 | 1:2.9 | 3.7 | 4 |

[1]CED (cathodic electrodipcoat), Cathoguard 310, layer thickness 20-22 μm
*to DIN 621415, 10 cycles
#to DIN 55996-1

The invention claimed is:

1. An aqueous chromium-free agent for anticorrosion conversion treatment of metallic surfaces comprising components:

(A) one or more water-soluble compounds containing at least one atom selected from elements titanium and/or zirconium, total concentration of said elements being no less than $2.5 \cdot 10^{-4}$ mol/l, but no greater than $2.0 \cdot 10^{-2}$ mol/l;

(B) one or more water-soluble compounds, as a source of fluoride ions, containing at least one fluorine atom;

the agent containing the elements of (A) and the fluorine of (B) in a molar ratio A:B of 1:z, z being a real number and greater than 6;

(C) one or more water-soluble compounds, which release copper ions, containing at least one copper atom; and (D) one or more water-soluble and/or water-dispersible compounds, which release metal ions, but are not a source of fluoride ions, containing at least one metal atom selected from the group consisting of aluminum and iron; and optionally further containing calcium;

said agent having a molar ratio D:B representing total number of component (D) metal atoms to total number of component (B) fluorine atoms, D:B:

being no less than $$\frac{z-6}{4z}$$

and where component (D) is composed at least of a water-soluble and/or water-dispersible compound containing at least one aluminum atom, the molar ratio D:B of the total number of component (D) aluminum atoms to the total number of component (B) fluorine atoms is no greater than $$\frac{z-6}{z}.$$

2. The agent as claimed in claim 1, wherein the molar ratio D:B of the total number of component (D) metal atoms to the total number of component (B) fluorine atoms is no less than $$\frac{z-6}{3z}.$$

3. The agent as claimed in claim 2, wherein the molar ratio D:B of the total number of component (D) metal atoms to the total number of component (B) fluorine atoms is no less than $$\frac{z-6}{2z}.$$

4. The agent as claimed in claim 1, wherein the agent has a molar ratio A:C of total number of atoms of the component (A) elements titanium and/or zirconium to total number of component (C) copper atoms which is no less than 1:3.

5. The agent as claimed claim 1, wherein the ratios D:B and A:C in each case do not exceed values which, once the agent has been brought into contact with a ferrous surface, for a treatment time of 90 s and at a treatment temperature of 30° C., result in an elemental loading on said surface of less than 20 $mg/m^2$ relative to the component (A) elements selected from titanium and/or zirconium.

6. The agent as claimed in claim 1, wherein component (D) is composed at least of a water-dispersible compound based on silicates containing aluminum.

7. The agent as claimed in claim 6, wherein component (D) is composed at least of a water-dispersible aluminum silicate with a ratio of aluminum to silicon atoms of at least 1:3.

8. The agent as claimed in claim 1, wherein total content of fluorine atoms corresponding to component (B) does not exceed 3 g/l.

9. The agent as claimed in claim 1, wherein total content of oxo anions of phosphorus is less than 1 ppm.

10. The agent as claimed in claim 1, wherein the agent has a pH value of no less than 2.5, but does not exceed a value of 5.

11. The agent as claimed in claim 10, wherein, in order to adjust total acid content, a buffer system is additionally present which at least exhibits a proteolysis equilibrium with a pK value in a range from 2.0 to 5.0.

12. An aqueous chromium-free agent for anticorrosion conversion treatment of metallic surfaces comprising components:

(A) one or more water-soluble compounds containing at least one atom selected from elements titanium and/or zirconium, total concentration of said elements being no less than $2.5 \cdot 10^{-4}$ mol/l, but no greater than $2.0 \cdot 10^{-2}$ mol/l;

(B) one or more water-soluble compounds, as a source of fluoride ions, containing at least one fluorine atom; the agent containing the elements of (A) and the fluorine of (B) in a molar ratio A:B of 1:z, z being a real number and greater than 6;

(C) one or more water-soluble compounds, which release copper ions, containing at least one copper atom; and (D) one or more water-soluble and/or water-dispersible compounds, which release metal ions, but are not a source of fluoride ions, containing at least one metal atom selected from the group consisting of calcium, aluminum and iron; said agent:

1) having a molar ratio D:B representing total number of component (D) metal atoms to total number of component (B) fluorine atoms, D:B:

being no less than $$\frac{z-6}{4z}$$

and 2) not falling below a value which, once the agent has been brought into contact with a ferrous surface for a treatment time of 90 s and at a treatment temperature of 30° C., results in an elemental loading on said surface of less than 20 $mg/m^2$ relative to the component (A) elements, wherein component (D) is composed at least of a water-soluble and/or water-dispersible compound containing at least one aluminum atom, and wherein the molar ratio D:B of the total number of component (D) aluminum atoms to the total number of component (B) fluorine atoms is no greater than $$\frac{z-6}{z}.$$

* * * * *